US009948071B2

(12) United States Patent
Chen et al.

(10) Patent No.: US 9,948,071 B2
(45) Date of Patent: Apr. 17, 2018

(54) IONIZER WITH A NEEDLE CLEANING DEVICE

(71) Applicant: Desco Industries, Inc., Chino, CA (US)

(72) Inventors: Qinfei Chen, Singapore (SG); Chee Ming Ng, Singapore (SG); Kam Poi Chia, Singapore (SG); John Zenon G Vallinan, Singapore (SG); Yoshiaki Sato, Singapore (SG); Siarhei V. Savich, Singapore (SG)

(73) Assignee: Desco Industries, Inc., Chino, CA (US)

( * ) Notice: Subject to any disclaimer, the term of this patent is extended or adjusted under 35 U.S.C. 154(b) by 418 days.

(21) Appl. No.: 14/429,920

(22) PCT Filed: Feb. 27, 2013

(86) PCT No.: PCT/US2013/027974

§ 371 (c)(1),
(2) Date: Mar. 20, 2015

(87) PCT Pub. No.: WO2014/046721

PCT Pub. Date: Mar. 27, 2014

(65) Prior Publication Data

US 2015/0236484 A1 Aug. 20, 2015

Related U.S. Application Data

(60) Provisional application No. 61/704,084, filed on Sep. 21, 2012.

(51) Int. Cl.
*H01T 19/04* (2006.01)
*H01T 23/00* (2006.01)

(52) U.S. Cl.
CPC ..... *H01T 19/04* (2013.01); *H01T 23/00* (2013.01)

(58) Field of Classification Search
CPC ..... H01T 19/04; H01T 23/00
(Continued)

(56) References Cited

U.S. PATENT DOCUMENTS 4,734,580 A 3/1988 Rodrigo et al.
5,768,087 A 6/1998 Vernitskiy
(Continued)

FOREIGN PATENT DOCUMENTS

DE 000010241651 A1 3/2004
JP 2004234972 B2 8/2004
(Continued)

OTHER PUBLICATIONS

Machine Translation of Noda WIPO patent document WO2010140434 Dec. 9, 2010.*
(Continued)

*Primary Examiner* — Thienvu Tran
*Assistant Examiner* — Kevin J Comber
(74) *Attorney, Agent, or Firm* — Berkeley Law & Technology Group, LLP

(57) ABSTRACT

An ionizer, including: an ionizing electrode for ionizing air and having a longitudinal first direction; and a cleaning member including a plurality of spaced apart bundles of bristles for cleaning the ionizing electrode when the cleaning member comes into contact with the ionizing electrode, each bundle of bristles in the plurality of spaced apart bundles of bristles being offset relative to the other bundles of bristles in the plurality of spaced apart bundles of bristles along the first direction and along a second direction perpendicular to the first direction.

8 Claims, 8 Drawing Sheets

(58) Field of Classification Search
USPC ..... 361/231
See application file for complete search history.

(56) References Cited

U.S. PATENT DOCUMENTS

| | | | | |
|---|---|---|---|---|
| 2010/0033891 | A1 | 2/2010 | Orihara et al. | |
| 2010/0188793 | A1* | 7/2010 | Uchida | H01T 23/00 361/231 |
| 2012/0068082 | A1 | 3/2012 | Noda | |
| 2015/0236484 | A1 | 8/2015 | Chen et al. | |

FOREIGN PATENT DOCUMENTS

| | | | | |
|---|---|---|---|---|
| TW | 200800402 | | 1/2008 | |
| WO | WO2009114258 | A2 | 9/2009 | |
| WO | WO 2010140434 | A1 * | 12/2010 | H01T 23/00 |
| WO | WO2014046721 | A1 | 3/2014 | |

OTHER PUBLICATIONS

International Search Report, dated Jun. 4, 2013, International Application No. PCT/US2013/027974, 6 pages.
Written Opinion of the International Searching Authority, dated Jun. 4, 2013, International Application No. PCT/US2013/027974, 9 pages.

* cited by examiner

II-II SECTION

IONIZER WITH A NEEDLE CLEANING DEVICE

BACKGROUND

Various types of ion generators or ionizers, for generating air ions by corona discharge and for neutralizing static electricity on an object, have been developed. Such ionizers typically have an electrode needle (or a discharging needle) for generating corona discharge. The discharging performance of the electrode needle may deteriorate, after use, when dirt and dust particles in the air electrostatically adhere to the tip of the needle, or when the surface of the needle becomes oxidized. It is therefore necessary to clean the electrode needle periodically.

U.S. Pat. No. 4,734,580 purportedly describes a built-in ionizing electrode cleaning apparatus having a wiper means, such as brushes, for cleaning accumulations of particulate material electrostatically adhered to the electrodes themselves.

U.S. Pat. No. 5,768,087 purportedly describes a cleaning device for automatically cleaning dust and dirt from ionizing electrodes.

U.S. Published Patent Application No. 2010/0188793 describes an ionizer having a cleaning system for cleaning an electrode needle of the ionizer automatically or remotely, while also being compact in size.

SUMMARY

Corona discharging devices included ionizers that have an ionizing electrode that can generate a corona discharge. The electrode is typically an ionizing electrode needle, having a sharp point. It is necessary to clean the electrode of an ionizer at a proper time interval. However, the ionizer may be used in a continuously operated system, such as semiconductor production equipment, and it is typically inefficient and undesirable to stop the system for cleaning of the ionizing electrode. It is also desirable to avoid manual cleaning of the ionizing electrode. Therefore, it is desired to clean the ionizing electrode automatically or remotely.

In a first aspect, the disclosure describes an ionizer including an ionizing electrode for ionizing air and having a longitudinal first direction, and a cleaning member for cleaning the ionizing electrode. The cleaning member includes a plurality of spaced apart bundles of bristles for cleaning the ionizing electrode when the cleaning member comes into contact with the ionizing electrode. Each bundle of bristles in the plurality of spaced apart bundles of bristles is offset relative to the other bundles of bristles in the plurality of spaced apart bundles of bristles along the first direction and along a second direction perpendicular to the first direction.

In some embodiments of the ionizer of the first aspect, when the cleaning member comes into contact with the ionizing electrode, a first bundle of bristles in the plurality of spaced apart bundles of bristles contacts the ionizing electrode closer to an emission tip of the ionizing electrode and a second bundle of bristles in the plurality of spaced apart bundles of bristles contacts the ionizing electrode farther from the emission tip of the ionizing electrode.

In some embodiments of the ionizer of the first aspect, when the cleaning member comes into contact with the ionizing electrode, a first bundle of bristles in the plurality of spaced apart bundles of bristles contacts the ionizing electrode along a first side of the ionizing electrode and a second bundle of bristles in the plurality of spaced apart bundles of bristles contacts the ionizing electrode along an opposite second side of the ionizing electrode.

In a second aspect, the disclosure describes an ionizer including a plurality of ionizing electrodes for ionizing air, each ionizing electrode having an emission tip, the tips of the ionizing electrodes being generally disposed in a first plane, and a plurality of cleaning members. Each cleaning member includes a plurality of spaced apart bundles of bristles for cleaning an ionizing electrode in the plurality of ionizing electrodes when the cleaning member contacts the ionizing electrode, and each bundle of bristles in the plurality of spaced apart bundles of bristles is offset relative to the other bundles of bristles in the plurality of spaced apart bundles of bristles along two mutually orthogonal directions parallel to the first plane.

In a third aspect, the disclosure describes an ionizer including an ionizing electrode for ionizing air, and a cleaning system for cleaning the ionizing electrode and including an arm elongated along a longitudinal axis of the arm and including a cleaning member, the cleaning member including a plurality of spaced apart bundles of bristles for cleaning the ionizing electrode when the cleaning member comes into contact with the ionizing electrode, each bundle of bristles in the plurality of spaced apart bundles of bristles being offset relative to the other bundles of bristles in the plurality of spaced apart bundles of bristles along a first direction parallel to the longitudinal axis of the arm and along a second direction perpendicular to the first direction.

In some embodiments of the ionizer of the third aspect, the arm is attached to a center and is configured to rotate about the center to move the cleaning member into contact with the ionizing electrode so that the plurality of spaced apart bundles of bristles clean the ionizing electrode and for moving the cleaning member away from the ionizing electrode.

In a fourth aspect, the disclosure describes an ionizer including a plurality of ionizing electrodes, each ionizing electrode being configured to ionize air, the ionizer being configured so that at least one predetermined ionizing electrode in the plurality of ionizing electrodes does not ionize air when at least one other predetermined ionizing electrode in the plurality of ionizing electrodes ionizes air. In some embodiments, the at least one predetermined ionizing electrode in the plurality of ionizing electrodes that does not ionize air is being cleaned.

In a fifth aspect, the disclosure describes an ionizer including a plurality of ionizing electrodes for ionizing air and being configured so that when an ionizing electrode in the plurality of ionizing electrodes is being cleaned, a different ionizing electrode in the plurality of ionizing electrodes ionizes air.

In a sixth aspect, the disclosure describes an ionizer including a plurality of ionizing electrodes for ionizing air, and a cleaning member for cleaning the plurality of ionizing electrodes, wherein when the cleaning member cleans a first ionizing electrode in the plurality of ionizing electrodes that is not ionizing air, a different second ionizing electrode in the plurality of ionizing electrodes ionizes air.

In a seventh aspect, the disclosure describes an ionizer including first and second ionizing electrodes for emitting ions, a predetermined one of the first and second ionizing electrodes emitting ions, a predetermined other one of the first and second ionizing electrodes not emitting ions; and a cleaning member contacting and cleaning the predetermined ionizing electrode that is not emitting ions.

In an eighth aspect, the disclosure describes an ionizer including a plurality of ionizing electrodes for ionizing air, a plurality of cleaning members for contacting and cleaning the plurality of ionizing electrodes, the cleaning members in the plurality of cleaning members being so arranged relative to the ionizing electrodes in the plurality of ionizing electrodes so that when a cleaning member in the plurality of cleaning members contacts an ionizing electrode in the plurality of ionizing electrodes, at least one other cleaning member in the plurality of cleaning members does not contact any ionizing electrode in the plurality of ionizing electrodes.

In a ninth aspect, the present disclosure describes an ionizer including a plurality of ionizing electrodes for ionizing air, and a plurality of cleaning members for contacting and cleaning the plurality of ionizing electrodes. Each cleaning member is configured to clean one ionizing electrode at a time and includes a plurality of spaced apart bundles of bristles, and each bundle of bristles in the plurality of spaced apart bundles of bristles is offset relative to the other bundles of bristles in the plurality of spaced apart bundles of bristles along at least two mutually orthogonal directions, such that when one cleaning member cleans an ionizing electrode, another cleaning member does not clean any other ionizing electrode.

Ionizers of the present disclosure are useful, for example, as corona discharging devices that can be operated continuously and cleaned under automation control while maintaining a highly consistent ion output.

Like reference numbers in the various figures indicate like elements. However, it will be understood that the use of a number to refer to a component in a given figure is not intended to limit the component in another figure labeled with the same number. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the description. In particular the dimensions of the various components are depicted in illustrative terms only, and no relationship between the dimensions of the various components should be inferred from the drawings, unless so indicated. Although terms such as "top", "bottom", "upper", lower", "under", "over", "front", "back", "outward", "inward", "up" and "down", and "first" and "second" may be used in this disclosure, it should be understood that those terms are used in their relative sense only unless otherwise noted. In particular, in some embodiments certain components may be present in interchangeable and/or identical multiples (e.g., pairs). For these components, the designation of "first" and "second" may apply to the order of use, as noted herein (with it being irrelevant as to which one of the components is selected to be used first).

DETAILED DESCRIPTION

Figure 1:
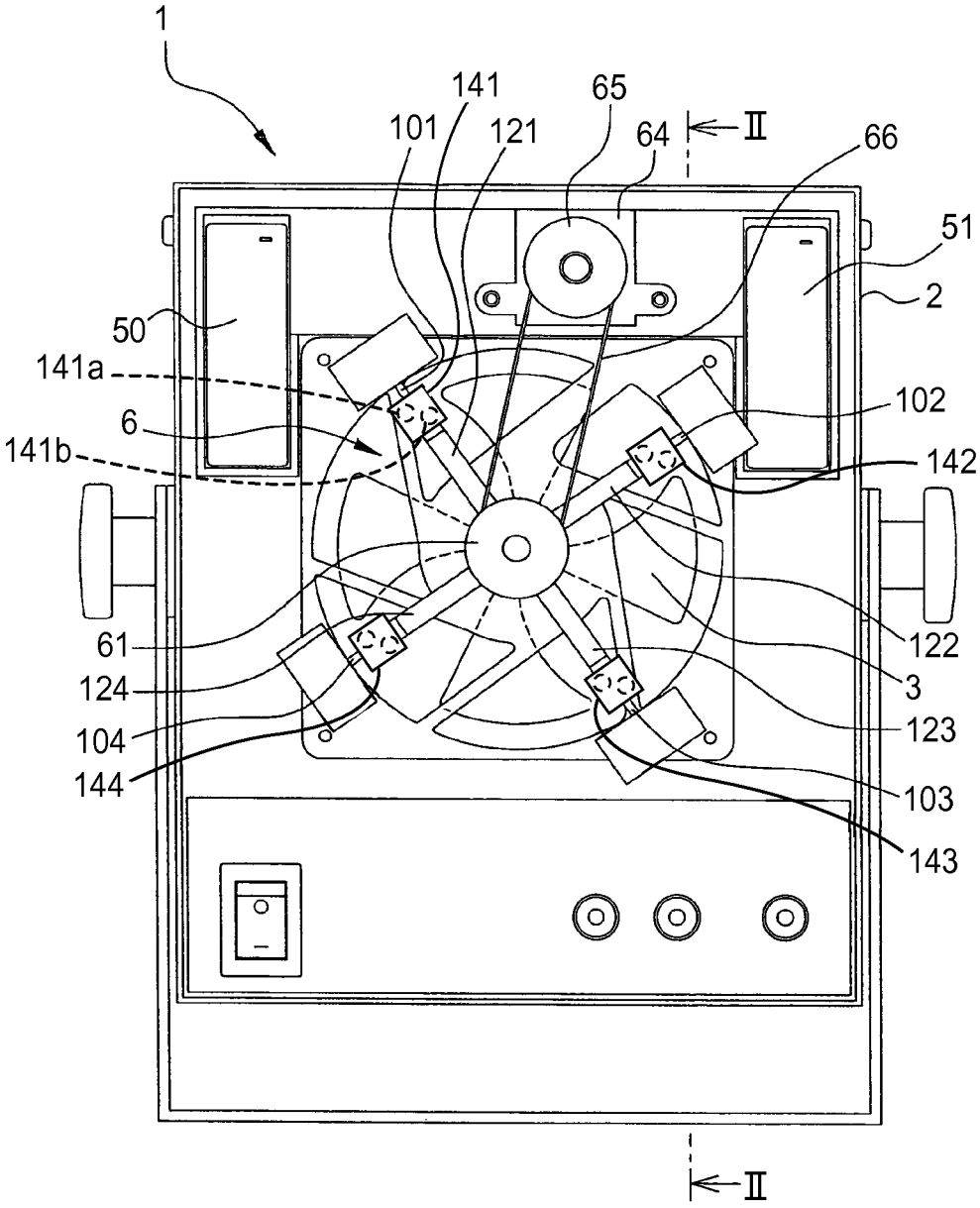
FIG. 1 is a font view of an ionizer according to an embodiment of the present disclosure.

FIG. 1 is a front view of an ionizer according to an exemplary embodiment of the present disclosure, and FIG. 2 is a cross-sectional view along II-II line in FIG. 1. In this embodiment, the ionizer is described as an example of a DC (direct-current) ionizer. The ionizer 1 includes a housing 2, a fan 3 contained in housing 2, ionizing electrode needles (generally pairs of needles) 101 to 104 for generating air ions by corona discharging, and high voltage power supplies 50, 51 for applying high voltage to ionizing electrodes 101 to 104. The ionizer 1 also includes an opposing electrode 40 for generating corona discharging between the opposing electrode and each ionizing electrode needle. In the embodiment shown, the ionizing electrodes are paired, and each pair of needles (in the embodiment, needles 101 and 103; 102 and 104) are located at opposing positions, and one needle of each pair (101 and 103) is connected to the positive power supply 50, and another needle of each pair (102 and 104) is connected to the negative power supply 51. By applying high voltage from the power supplies, corona discharging is generated between each ionizing electrode needle and the opposing electrode 40. The opposing electrode 40 is connected to ground via housing 2. Air ions may be generated by corona discharging. The generated air ions are conveyed towards an object (not shown) to be electrically neutralized, with an air flow generated by fan 3.

The ionizer 1 includes a cleaning system 6 (i.e., "a needle cleaning device") for cleaning each ionizing electrode. The cleaning system 6 has a rotating member 61 configured to coaxially rotate with the fan 3, a plurality of (four in the embodiment) rods 121 to 124 attached to the rotating member 61 such that each rod extends radially from the rotating member, and cleaning members 141 to 144 each attached to the end of a corresponding rod 121 to 124. The number of the rods or the cleaning members may be smaller than or equal to the number of the ionizing electrodes. An increased number of cleaning members relative to the number of ionizing electrodes allows the range of rotating angle of the rotating member 61 to be reduced, resulting in a reduction of cleaning time. When one cleaning member cleans a plurality of ionizing electrodes, a cleaning effect may vary in each ionizing electrode, due to a fabrication error of each needle or cleaning member. On the other hand, when one cleaning member is dedicated to cleaning a single ionizing electrode, the positional relation between each cleaning member and its corresponding electrode may be adjusted individually.

The rotating member 61 is driven by an actuator 64, which is an electromagnetic solenoid in the embodiment. At this point, the term "actuator" means a component converting an input energy into a physical momentum, for example, a mechanical element constituting a mechanical or electrical circuit. In the present invention, the actuator is activated by an electric signal or the like, so as to cause a bi-directional movement (for example, a linear or rotational movement) of a certain member between two positions. Contrarily, the actuator does not include an electric motor or an engine, which continuously generates motive energy. As the actuator other than the electromagnetic solenoid, a hydraulic actuator or another actuator having a shape-memory metal and utilizing Joule heat generated by input current may be used. These actuators basically generate momentum by being applied energy. When such an actuator is used in a device, the actuator is incorporated in a control system and controlled by an electric signal or the like.

In the illustrated example, the actuator or the electromagnetic solenoid 64 is positioned around the fan 3 or on the lateral side of the fan 3 in relation to the direction of the air flow generated by the fan 3. The power from the electromagnetic solenoid 64 is transmitted to the rotating member 61 via a coupling means 66. As the coupling means 66, a conventional belt, chain, wire or a crank mechanism may be used. It is advantageous to use a flat belt or a wire having a simple structure, in view of reducing a production cost and/or a weight of the ionizer. Further, since it is not necessary to position each cleaning member relative to each ionizing electrode with high accuracy, there is no problem if the flat belt or the wire, which may introduce a certain level of slip motion, is used.

In the embodiment shown in FIG. 1, electromagnetic solenoid 64 is positioned at the lateral side of fan 3. Therefore, the thickness or the length in the direction of air flow of ionizer 1 is not lengthened due to the existence of the actuator, whereby so called a thin-shaped ionizer may be constituted. Further, a component of the cleaning system, positioned in the air flow area by fan 3, may be only the flat belt, the air resistance of which is substantially negligible. Accordingly, the amount of air flow of the ionizer is minimally reduced. As a result, it is not necessary to use a fan with high-capacity, whereby the ionizer may be compactly constituted.

Next, the operation of cleaning system 6 in the embodiment shown in FIG. 1 will be explained. When a switch (not shown) for electromagnetic solenoid 64 is turned on, solenoid 64 is activated (in this case, an element such as a pulley 65 of solenoid 64 is rotated). At this point, pulley 65 is not continuously rotated in one direction, but exhibits the reciprocal motion within a predetermined angle range. The predetermined angle range is set such that each cleaning member may clean each ionizing electrode in both directions opposed to each other and such that each cleaning member may be positioned sufficiently away from each ionizing electrode so as not to be subjected to heat by discharging of the ionizing electrode when solenoid 64 is not activated (or the actuation is terminated). The wider angle range may lengthen the cleaning time. On the other hand, when the angle range is too narrow, the cleaning member cannot be positioned sufficiently away from the ionizing electrode. For example, when four cleaning members are provided for four ionizing electrodes, as illustrated, a typical angle range of each rod attached to rotating member 61 is equal to or larger than 20 degrees. Also, the angle range is typically equal to or smaller than 60 degrees. Due to such a configuration, the cleaning members may be substantially integral with rotating member 61 coupled to pulley 65 of electromagnetic solenoid 64 via coupling means 66, and each bundle of bristles may clean each ionizing electrode in both (right-and-left) directions.

In one embodiment, when the rotation angle range of rotating member 61 rotated by electromagnetic solenoid 64 is 45 degrees, each rod is positioned at an initial position or a first position, e.g., away counterclockwise from each corresponding ionizing electrode by 22.5 degrees, before the activation of the solenoid 64. Upon the activation of the electromagnetic solenoid 64, the pulley 65 coupled to the solenoid 64 is clockwise rotated such that each cleaning member is moved to and stopped at a second position, e.g., clockwise from corresponding ionizing electrode by 22.5 degrees, after contacting (or cleaning) the ionizing electrode. Then, the pulley 65 is reversely or counterclockwise rotated, and each cleaning member contacts or cleans corresponding ionizing electrode in the opposite direction, and returns to the initial position. Such a cleaning motion may be performed only in one direction or both directions, in one cleaning operation. When the cleaning motion is performed in both directions, both sides of each ionizing electrode may be cleaned, whereby the cleaning effect may be improved. By performing such a cleaning operation at a proper time interval (for example, once per 24 hours), each ionizing electrode may be kept clean sufficiently to maintain a required level of ionizing. In addition, the cleaning motion may include several times of reciprocating motion in one cleaning operation.

In some embodiments, the stopping position of the cleaning member may be controlled by using the actuator having the simple motion, without using an intricate circuit or the like. As the electromagnetic solenoid 64, a mono-directional solenoid configured to rotate from a first position to a second position upon turning on a power switch (not shown) or inputting a control signal, and to return to the first position upon turning off the power switch or inputting another control signal. Alternatively, the electromagnetic solenoid may be a bi-directional solenoid configured to rotate in both directions by electromagnetic power. Since the mono-directional solenoid uses a spring or the like to return to the first position from the second position, a driving force for rotating the solenoid from the first position to the second position may be partially canceled by the spring force. Thus, the driving force may be different in each rotating direction. On the other hand, the bi-directional solenoid is rotated by the electromagnetic force in both directions, and therefore, a driving torque thereof is generally higher than that of the mono-directional solenoid. Also, the driving torque of the bi-directional solenoid is not so different in each direction. Further, the energy efficiency of the bi-directional solenoid is generally higher than that of the mono-directional solenoid, since the torque of the bi-directional solenoid is not canceled by the spring or the like. In addition, although the illustrated actuator is a rotary electromagnetic solenoid, a linear electromagnetic solenoid or an air solenoid may be used alternatively.

The cleaning members include bundles of bristles. In some embodiments, cleaning members include bundles of bristles offset from each other in a selected configuration. For example, FIG. 2B shows an embodiment of cleaning member 141 that includes spaced apart first and second bundles of bristles 141*a* and 141*b*, shown as being offset relative to each other, and the spaced apart bundles of bristles are shown at a moment during the cleaning when first bundle of bristles 141*a* is located in front of ionizing electrode 101, and second bundle of bristles 141*b* is located behind ionizing electrode 101.

Figure 2A:
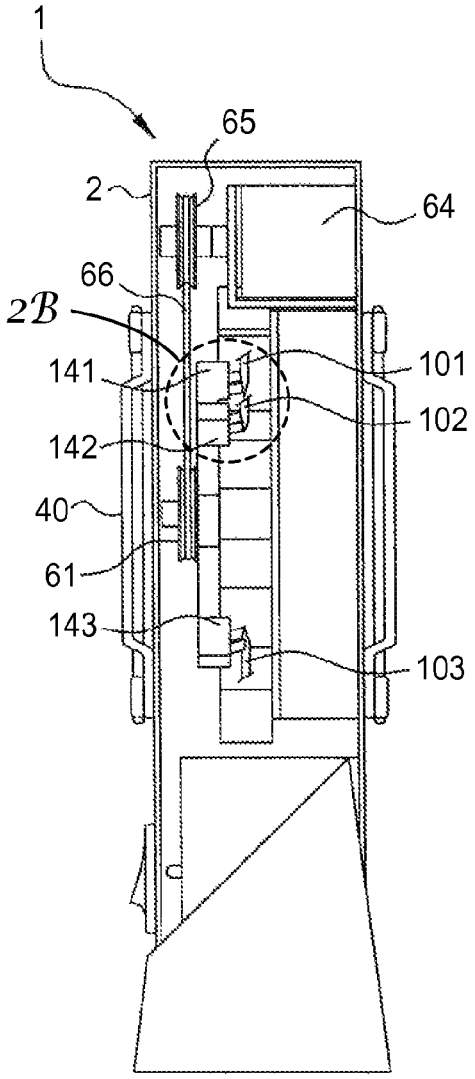
FIG. 2A is a cross-sectional view of the ionizer of FIG. 1.
Figure 2B:
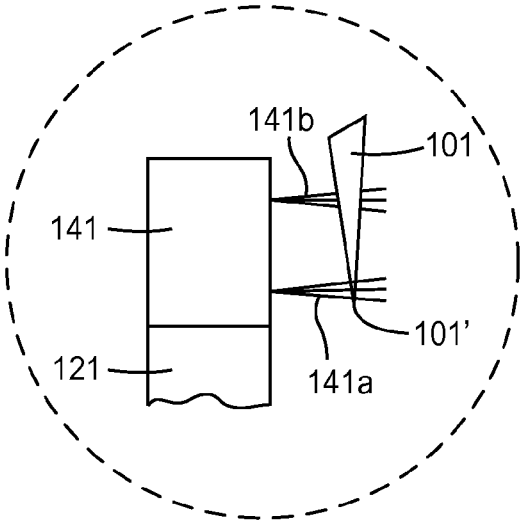
FIG. 2B is an enlargement of a portion of FIG. 2A.
Figure 3:
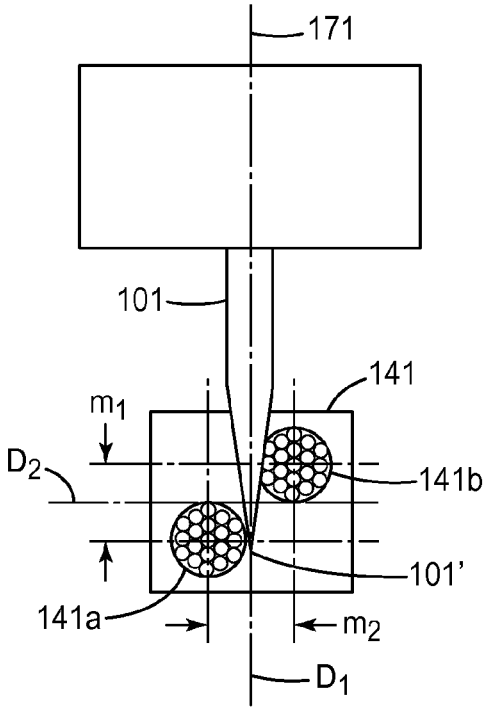
FIG. 3 is a schematic view showing a cleaning member according to an embodiment of the present disclosure.

FIG. 3 provides another view of the embodiment of cleaning member 141 included in FIGS. 1, 2A, and 2B, looking end-on at spaced apart bundles of bristles 141*a* and 141*b*. In this embodiment, bundle of bristles 141*a* is offset relative to bundle of bristles 141*b* along a first direction $D_1$ (shown in FIG. 3 as aligned with ionizing electrode axis 171), and along a second direction $D_2$ perpendicular to the first direction $D_1$. In the particular embodiment shown in FIG. 3, first bundle of bristles 141*a* contacts ionizing electrode 101 closer to emission tip 101' of ionizing electrode 101, and second bundle of bristles 141*b* contacts ionizing electrode 101 farther from emission tip 101'. In FIG. 3, the offset along first direction $D_1$ is shown as $m_1$, and the offset along second direction $D_2$ is shown as $m_2$. Typically, values for $m_1$ and $m_2$ are each on the order of a few millimeters.

Figure 4:
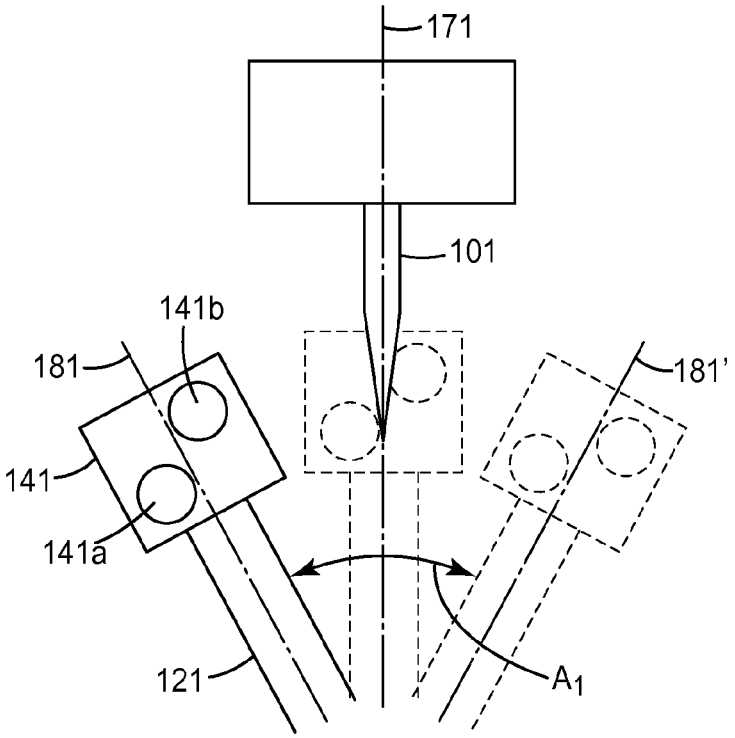
FIG. 4 is a schematic view showing a cleaning member cleaning an ionizing electrode of the present disclosure.

FIG. 4 shows cleaning member 141 and corresponding rod 121 sweeping from left to right through arc A1 in order to bring bundles of bristles 141*a* and 141*b* in contact with ionizing electrode 101. As rod 21 moves from being aligned with an axis 181 to ionizing electrode axis 171, at least one of the bundles of bristles 141*a* and 141*b* should contact the tip 101' of ionizing electrode 101. Rod 121 then sweeps past axis 171 to an axis 181', and typically rod 121 is then swept back through arc $A_1$, again bringing cleaning member 141 into contact with the tip of ionizing electrode 101.

Advantageously, because of the offset of the bundles of bristles 141*a* and 141*b* along first direction $D_1$, the positioning of ionizing electrode 101 during manufacture need not be as precise as when the cleaning member has only one bundle of bristles or when the bundles of bristles are not offset along first direction $D_1$.

As a further advantage, because of the offset of the bundles of bristles along second direction $D_2$, the torque required to move cleaning member 141 through arc A1 for cleaning ionizing electrode 101 is less than if more than one bundle of bristles simultaneously comes into contact with ionizing electrode 101. Consequently, and desirably, a more compact, lower-powered actuator can be used for turning rotating member 61.

Figure 5:
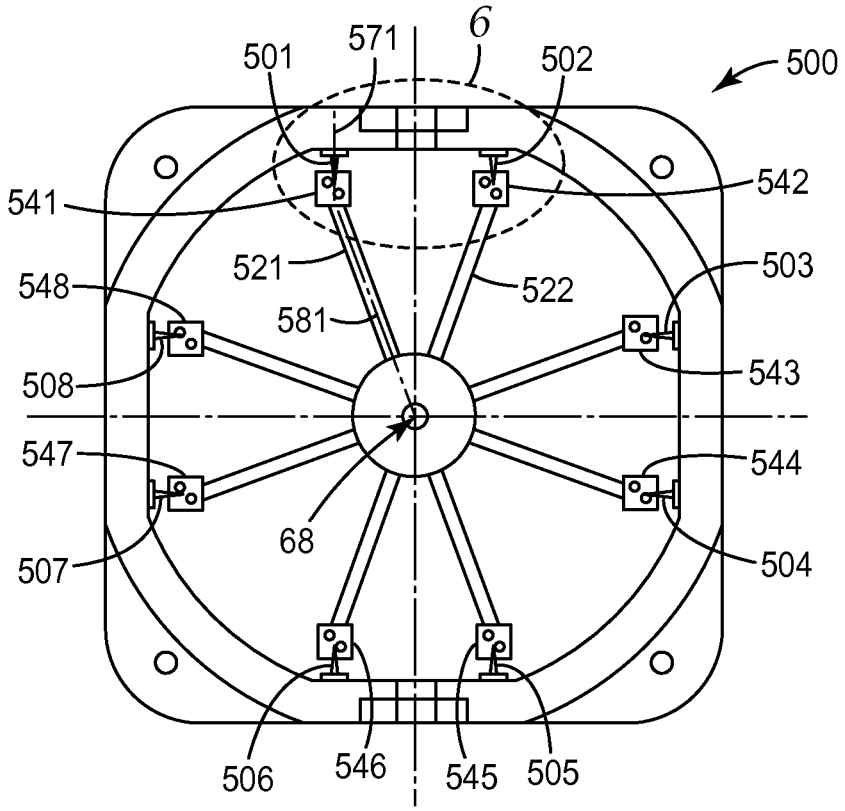
FIG. 5 is a back view of an ionizer according to an embodiment of the present disclosure.

FIG. 5 shows an embodiment of an ionizer 500 having eight ionizing electrodes 501 to 508, and eight cleaning members 541 to 548 disposed on corresponding rods (e.g., 521, 522) that turn around fan center 68. While ionizer 500 is shown as having eight ionizing electrodes 501 to 508 each being contacted by corresponding cleaning members 541 to 548 all at the same time, the amount of torque required for moving the cleaning members 541 to 548 back and forth across corresponding ionizing electrodes 501 to 508 is made less by having the bundles of bristles spaced apart and offset relative to each other (as opposed to an alternate configuration, for example, of having the bundles of bristles on each cleaning member aligned along a longitudinal axis of the corresponding ionizing electrode). Since the bundles of bristles on each cleaning member 541 to 548 are spaced apart and offset along second direction $D_2$, (i.e., perpendicular to the longitudinal direction of each respective ionizing electrode 501 to 508), the bundles of brushes on any individual cleaning member do not all come into contact with the respective ionizing electrodes at the same instant during the rotation of the cleaning members around fan center 68, and hence a cleaning operation does not require as much torque from the ionizer's actuator as when multiple bundles of bristles on each of the cleaning members are brought into contact their respective ionizing electrodes simultaneously.

Figure 6:
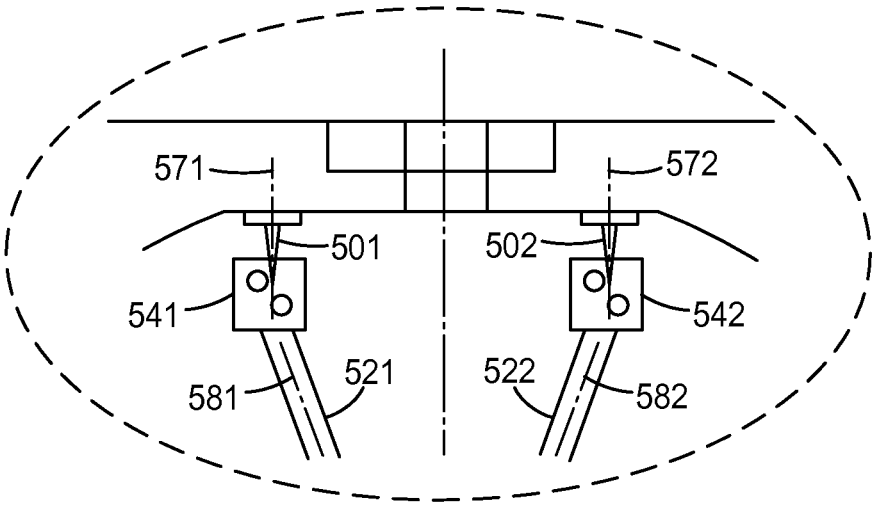
FIG. 6 is an enlargement of a portion of FIG. 5.

FIG. 6 shows an enlarged portion of FIG. 5, including a pair of ionizing electrodes 501 and 502 having corresponding pair of electrode longitudinal axes 571 and 572. In the embodiment shown, electrode longitudinal axes 571 and 572 are parallel, although in some embodiments the axes need not be parallel. As shown, when cleaning members 541 and 542 contact ionizing electrodes 501 and 502, respectively, neither of rod axes 581 or 582 is aligned with electrode longitudinal axes 571 and 572. Accordingly, it is seen that in some embodiments longitudinal axes of the ionizing electrodes in ionizer 500 need not be aligned with the rod axes for cleaning to occur, since the spaced apart bundles of bristles on the cleaning members 541 and 542 can still be brought into contact with ionizing electrodes 501 and 502 for cleaning.

Figure 7A:
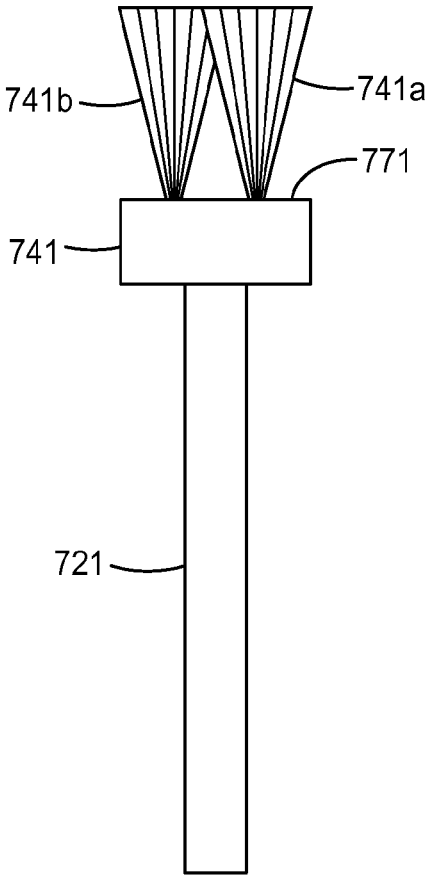
FIGS. 7A and 7B are side and end views, respectively, of a cleaning member according to an embodiment of the present disclosure.
Figure 7B:
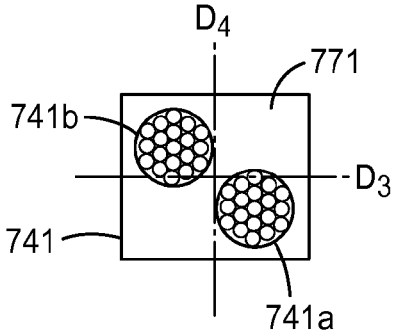
Figure 7C:
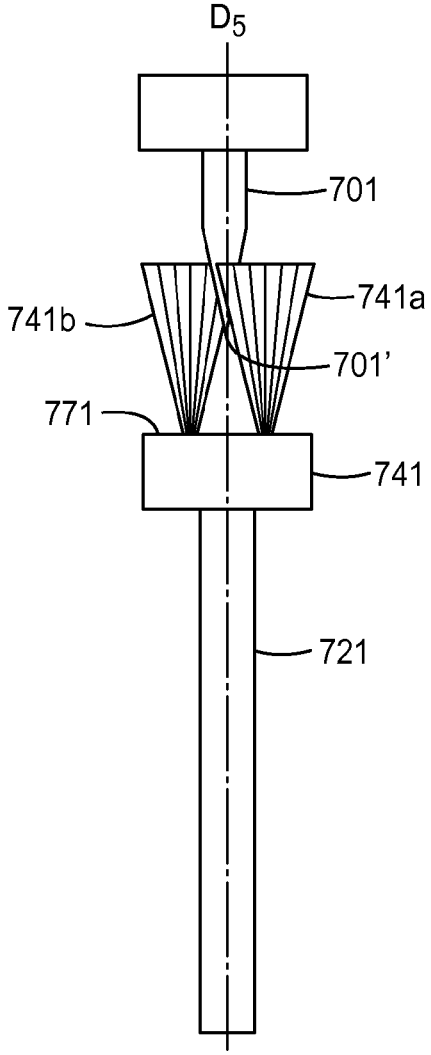
FIG. 7C shows the cleaning member of FIGS. 7A and 7B contacting an ionizing electrode.

Referring back to the embodiments shown in FIGS. 2B and 3, when the cleaning member 141 comes into contact with ionizing electrode 101, at least some of the bristles in the plurality of spaced apart bundles of bristles (e.g., 141*a* and 141*b*) are shown as being oriented along a third direction that is perpendicular to the first and second directions $D_1$ and $D_2$. FIGS. 7A and 7B show views of an alternative embodiment, where cleaning member 741 (shown as being on rod 721) includes spaced apart bundles of bristles 741*a* and 741*b* extending from face 771, and offset relative to each other along the two mutually perpendicular directions $D_3$ and $D_4$. As shown in FIG. 7C, when bundles of bristles 741*a* and 741*b* are brought into contact with ionizing electrode 701, at least some of the bristles in bundles of bristles 741*a* and 741*b* are oriented along direction $D_5$, which coincides with a longitudinal axis of ionizing electrode 701, and direction $D_5$ is also seen to be perpendicular to face 771, which is parallel to a plane that includes directions $D_3$ and $D_4$. In effect, at least some of the bristles in bundles of bristles 741*a* and 741*b* are oriented "in-line" with the longitudinal axis of ionizing electrode 701, and the "set apart" arrangement of the bundles of bristles provides advantages including reducing both the precision and torque required to sweep cleaning member 741 across ionizing electrode 701 in order to clean the tip of ionizing electrode 701.

Typically, power to an ionizing electrode is switched off to permit cleaning of the ionizing electrode and avoid causing damage to the cleaning member. In other words, it may be undesirable to bring a cleaning member into contact with an ionizing electrode, as the cleaning member may become damaged. However, it is also desirable to minimize interruption of the ionizer during a continuous production operation. Accordingly, it is desirable to provide an ionizer capable of switching off only some of the ionizing electrodes for a given period of time, to permit cleaning of those switched-off electrodes, while other ionizing electrodes continue to produce air ions.

In some embodiments, an ionizer of the present disclosure has a plurality of ionizing electrodes configured so that at least one predetermined ionizing electrode in the plurality of ionizing electrodes does not ionize air when at least one other predetermined ionizing electrode in the plurality of ionizing electrodes does ionize air. The at least one ionizing electrode that is not ionizing air is thus available to be cleaned, while the at least one other ionizing electrodes remain in operation, providing for a continuous operation of the ionizer even during cleaning operations.

Figure 8A:
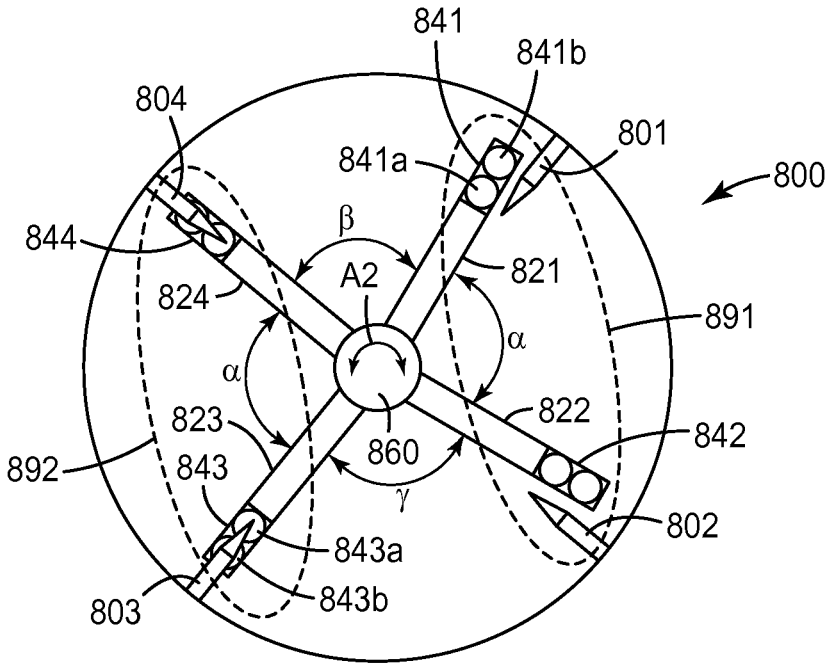
FIGS. 8A and 8B are back views of an ionizer according to an embodiment of the present disclosure, showing two different positions of the cleaning members with respect to the ionizing electrodes.
Figure 8B:
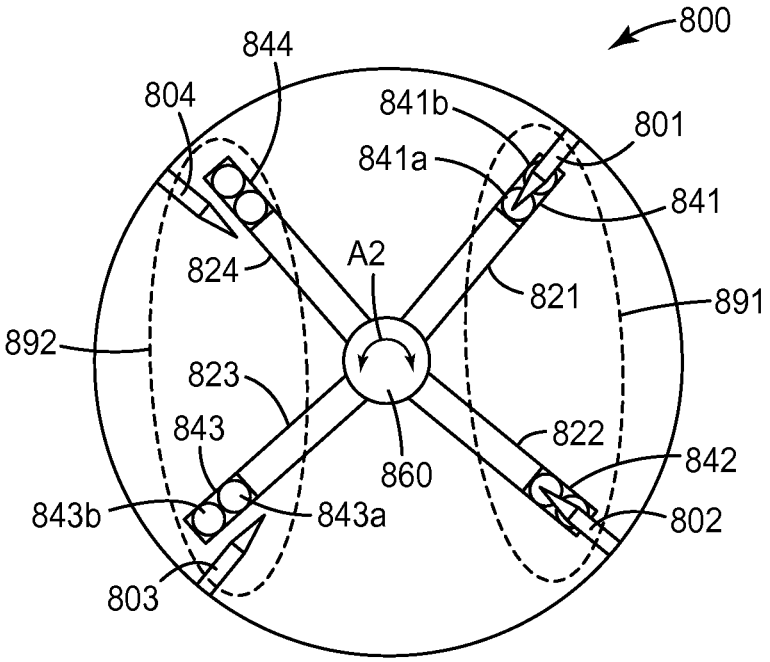

In some further embodiments, an ionizer (e.g., ionizer 800 shown in FIGS. 8A and 8B) can include pairs of ionizing electrodes associated as positive and negative ionizing electrodes (e.g., according to the following pairings: 801 and 802; 803 and 804), providing for a flow of positively and negatively charged ions that can be blown (e.g., by an ionizer fan) onto a surface to be neutralized. FIG. 8A shows an embodiment of such an ionizer 800, including a first pair of ionizing electrodes 891 (i.e., ionizing electrodes 801 and 802), and a second pair of ionizing electrodes 892 (i.e., ionizing electrodes 803 and 804), with ionizing electrodes 801 and 803 configured to emit negative ions, and ionizing electrodes 802 and 804 configured to emit positive ions. Ionizer 800 can be configured so that first pair 891 of ionizing electrodes does not ionize air when second pair 892 of ionizing electrodes ionizes air, and vice versa. Advantageously, the pair of ionizing electrodes not ionizing air is available for cleaning, while the other pair of ionizing electrodes continues to provide for a flow of both positive and negative air ions, so that ionizer 800 can provide a flow of both positive and negative air ions even during a cleaning operation. Thus, in FIG. 8A, first pair of ionizing electrodes 891 can be emitting positive and negative ions while second pair of ionizing electrodes 892 is being cleaned (by cleaning members 843 and 844). FIG. 8B then shows the opposite condition, where, second pair of ionizing electrodes 892 can be emitting positive and negative ions while first pair of ionizing electrodes 891 is being cleaned (by cleaning members 841 and 842). While FIGS. 8A and 8B show an ionizer with a total of four ionizing electrodes 801 to 804, the ionizer could be configured to include more ionizing electrodes, and typically in pairings for generation of positive and negative ions.

During cleaning of ionizing electrodes, if all of the cleaning members simultaneously contact the corresponding ionizing electrodes, a rotational resistance can be generated at that moment that requires using an actuator having a relatively large torque and a power source. In order to clean the ionizing electrode at a relatively low torque, the cleaning system may be constituted such that all of the cleaning members do not simultaneously clean (or contact) the ionizing electrodes. For example, when the ionizing electrodes are positioned at equal angular intervals as shown in FIGS. 8A and 8B, angular intervals between neighboring rods attached to a rotating member 860 may not be equal (in the illustrated embodiment, the four rods 821 to 824 are not positioned at intervals of 90 degrees). As shown in FIG. 8A, an angle $\alpha$ between rods 821 and 822, or between rods 823 and 824, can be 90 degrees, while on the other hand, an angle $\beta$ between rods 821 and 824 can be somewhat less than 90 degrees, and an angle $\gamma$ between rods 822 and 823 can be somewhat larger than 90 degrees. In other words, cleaning members (for example, 841 and 842) for cleaning the first pair of ionizing electrodes 891 (i.e., ionizing electrodes 801 and 802) are positioned away from each other by 90 degrees, so as to simultaneously clean the corresponding ionizing electrodes. Each angle between each rod may be adjusted such that each brush may clean the corresponding ionizing electrode at the different timings. With reciprocating rotation of rotating member 860 back and forth through arc $A_2$ for a cleaning operation, contact resistance against the ionizing electrodes can be limited to instances where fewer than all of the ionizing electrodes are contacted against cleaning members at the same instant. In other embodiments when the ionizing electrodes are not equally positioned, the same effect may be obtained by arranging the rods at angular intervals suitable for asynchronously contacting selected sub-groups of ionizing electrodes.

Figure 9:
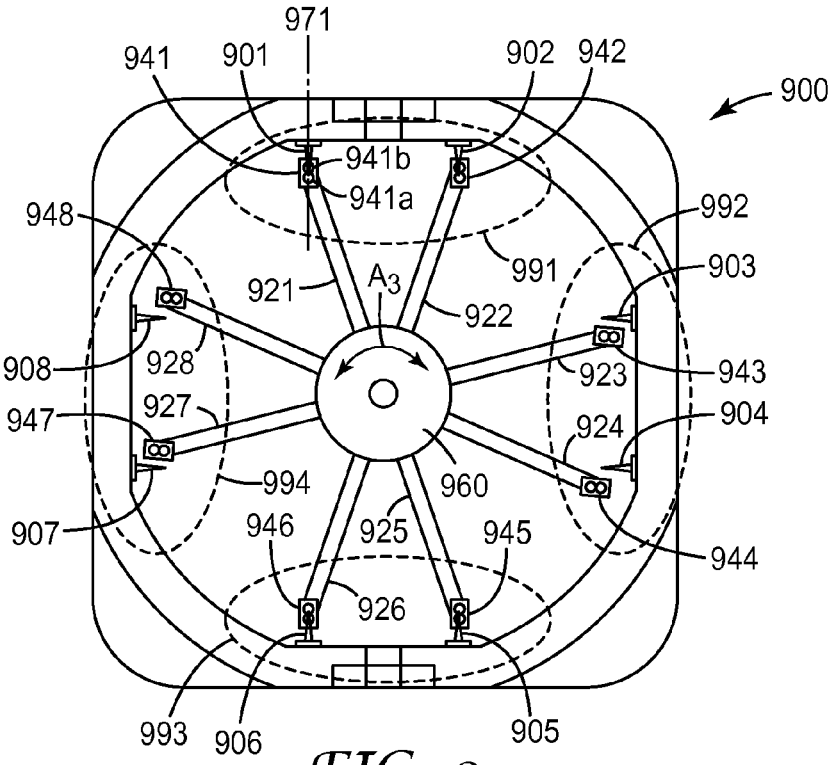
FIG. 9 is a back view of an ionizer according to an embodiment of the present disclosure.

FIG. 9 shows an embodiment of an ionizer 900 that includes ionizing electrodes 901 to 908 and eight corresponding cleaning members 941 to 948, each cleaning member having a corresponding rod 921 to 928, and each of rods 928 to 928 is attached to rotating member 960 that reciprocates back and forth through arc $A_3$ for a cleaning operation. While the configuration of ionizing electrodes shown in ionizer 900 is essentially the same as that shown for ionizer 500 in FIG. 5, cleaning members 941 to 948 differ from cleaning members 541 to 548 in how the bundles of bristles are spaced apart. In cleaning member 941, for example, bundles of bristles 941*a* and 941*b* are shown as being aligned with electrode longitudinal axis 971 of ionizing electrode 901. It can be seen from FIG. 9 that each of cleaning members 941 to 948 similarly has the bundles of bristles all positioned to align with the corresponding electrode longitudinal axes when the corresponding cleaning members 941 to 948 are brought in to contact with the corresponding ionizing electrodes 901 to 908. Ionizer 900 also differs from ionizer 500 in that the ionizing electrodes 901 to 908 are grouped as electrode pairs 991 to 994. In some embodiments, electrode pairs 991 to 994 are each include an ionizing electrode configured to emit negative ions (e.g., ionizing electrodes 901, 903, 905, 907), and an ionizing electrodes configured to emit positive ions (e.g., ionizing electrodes 902, 904, 906, 908). Further, ionizer 900 is shown as having electrode pairs 991 and 993 being contacted by corresponding cleaning members 941, 942, 945 and 946, while electrode pairs 992 and 994 are not being contacted by corresponding cleaning members 943, 944, 947, and 948. Ionizer 900 thus represents a kind of "doubling" of ionizer 800 with respect to having two groupings of ionizing electrodes (each "grouping" including two pairs of ionizing electrodes), where at most one of the groupings ionizing electrodes can contact a corresponding grouping of cleaning members at any given time during a cleaning operation. In each of ionizers 800 and 900, it is also possible that the cleaning members can be moved into a position where none of the ionizing electrodes contacts a cleaning member. As with ionizer 800, ionizer 900 is also configured so that power to the particular ionizing electrodes brought into contact with corresponding cleaning members is selectively switched off for those ionizing electrodes, while the remaining ionizing electrodes can still have power for generating air ions.

In both ionizers 800 and 900, the spaced apart bundles of brushes on each cleaning member are shown as being offset relative to each other along an electrode longitudinal axis of the corresponding electrode, but not offset along a second direction perpendicular to the electrode longitudinal axis. For example, bundles of bristles 941*a* and 941*b* are shown as aligned along electrode longitudinal axis 971. In this configuration of the cleaning members, the torque required to sweep groups of cleaning members across the ionizing electrodes is not as low as in an alternate configuration (not shown) where each of the cleaning members have the bundles of brushes offset along both the corresponding electrode longitudinal axis and a second direction perpendicular to the electrode longitudinal axis. Significantly, however, the required torque is reduce by having at least one pair of cleaning members not contact corresponding ionizing electrodes at any given time during a cleaning operation, and such configuration includes those arrangements of rods and cleaning members shown in ionizers 800 and 900. In particular, comparison of ionizer 500 (see FIG. 5) and ionizer 900 (see FIG. 9) illustrates two approaches to achieving a reduction in required torque by either selecting the configuration of the spaced apart bundles of bristles in ionizer 500, or alternatively by selecting the angular distribution of rods 921 to 928 to provide for having fewer than all of the cleaning members contact the corresponding ionizing electrodes at any time during a cleaning operation.

Figure 10:
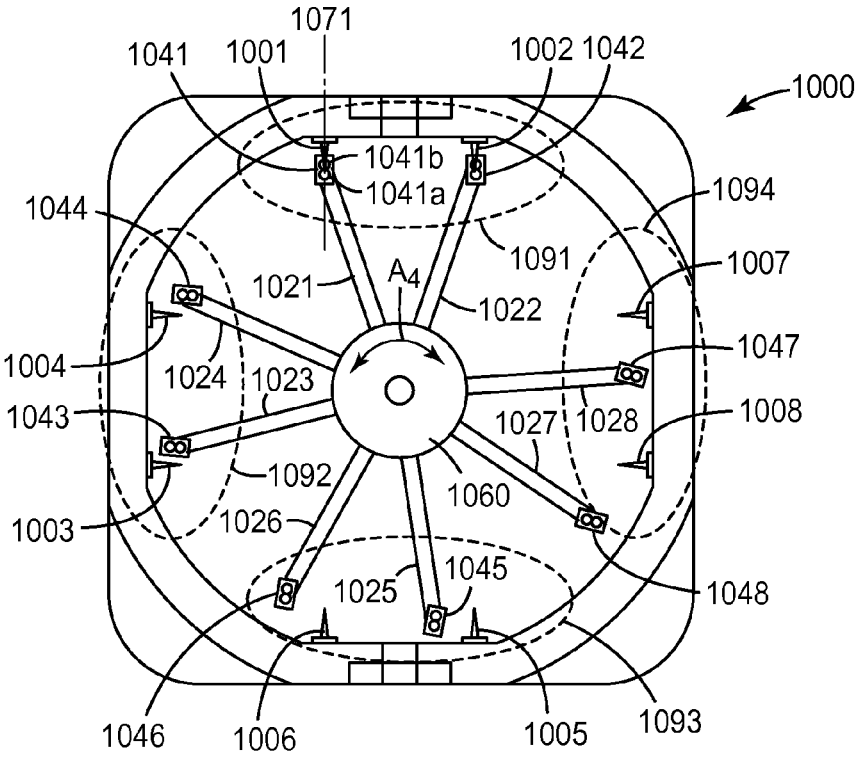
FIG. 10 is a back view of an ionizer according to an embodiment of the present disclosure.

FIG. 10 shows an embodiment of an ionizer 1000 that includes ionizing electrodes 1001 to 1008 grouped into four separate electrode pairs 1091 to 1094, and as with ionizer 900 electrode pairs 1091 to 1094 are each include an ionizing electrode configured to emit negative ions (e.g., ionizing electrodes 1001, 1003, 1005, 1007), and an ionizing electrodes configured to emit positive ions (e.g., ionizing electrodes 1002, 1004, 1006, 1008). However, ionizer 1000 differs significantly from ionizer 900 in that an angular distribution of rods 1021 to 1028 is configured to permit at most one of electrode pairs 1091 to 1094 to contact a corresponding pair of cleaning members. For example, FIG. 10 shows ionizer 1000 at an instant during a cleaning process when ionizing electrodes 1001 and 1002 of electrode pair 1091 are contacted by cleaning members 1041 and 1042, but none of electrode pairs 1092, 1093, or 1094 can be contacted by corresponding cleaning members at the same instant. In this configuration, the torque required to turn rotating member 1060 during a complete cleaning operation can be less than the torque required to complete a cleaning operation with ionizer 900, for example.

In normal operation, ionizer 1000 can rotating member 1060 positioned so that none of ionizing electrodes 1001 to 1008 contacts a cleaning member. For a typical cleaning operation, rotating member 1060 first rotates counterclockwise through arc A4, so that each of electrode pairs 1091 to 1094 is successively swept by the corresponding pairs of cleaning members (i.e., electrode pair 1091 is swept by cleaning members 1041 and 1042; electrode pair 1092 is next swept by cleaning members 1043 and 1044; electrode pair 1093 is next swept by cleaning members 1045 and 1046; and finally electrode pair 1093 is swept by cleaning members 1047 and 1048), and then rotating member 1060 can be rotated clockwise to again sweep the ionizing electrodes, one pair at a time, with the corresponding cleaning members.

Figure 11:
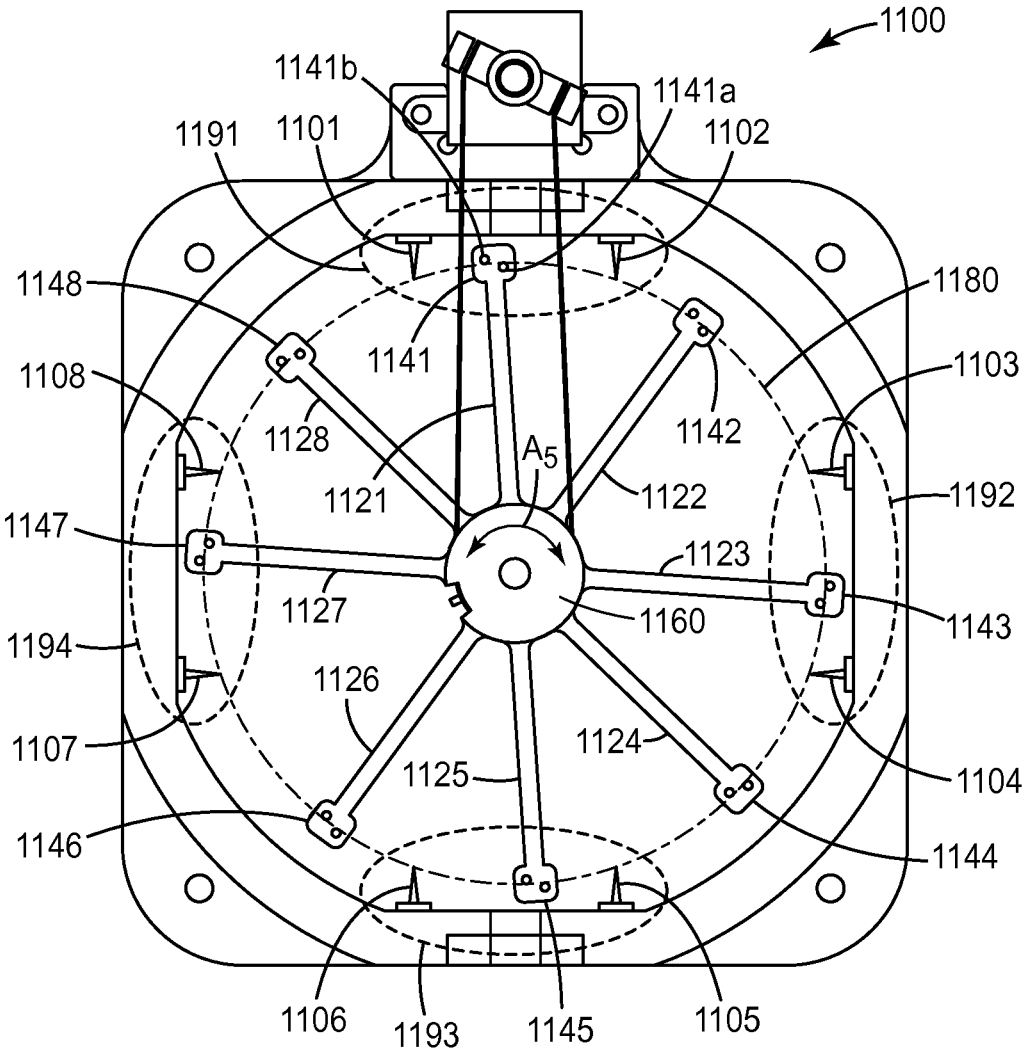
FIG. 11 is a front view of an ionizer according to an embodiment of the present disclosure.

FIG. 11 shows an embodiment of an ionizer 1100 that combines several features of the other embodiments of ionizers of the present disclosure. Ionizer 1100 is similar to ionizer 1000 but with the feature that the bundles of bristles in each of cleaning members 1141 to 1148 are spaced apart in a manner similar to that shown in ionizer 500 (see FIG. 5), and as was shown in more detail in FIG. 3. Ionizer 1100 thus includes a pairing of electrodes 1101 to 1108 into electrode pairs 1191 to 1194, and each of electrode pairs 1191 to 1194 can be switched on or off separately. Rods 1121 to 1128 have an angular distribution that permits at most one of electrode pairs 1191 to 1194 to contact a corresponding cleaning member. Normal operation can be as described for ionizer 1000, with rotating member 1160 rotating through arc $A_5$ to bring pairs of cleaning members successively into contact with corresponding (and switched off) ionizing electrode pairs 1191 to 1194.

FIG. 11 also shows a dashed circle 1180 that lies in a plane that includes the ionizer tips of each of the ionizing electrodes 1101 to 1108. Typically, for ionizers of the present disclosure, the ionizing electrodes are disposed within the same plane (e.g., for the embodiment shown in FIG. 11, the plane that includes dashed circle 1180). In some embodiments where the ionizing electrodes are disposed in a same plane, at least some of the bristles in the plurality of spaced apart bundles of bristles on the cleaning members can be oriented generally perpendicular to the plane. In some other embodiments where the ionizing electrodes are disposed in a same plane, at least some of the bristles in the plurality of spaced apart bundles of bristles on the cleaning members can be oriented generally parallel with the plane.

While ionizers shown in the Figures typically have 4 or 8 ionizing electrodes, other configurations can also be selected where a different number of ionizing electrodes is included, for example, 10, 12, 14, 16, or even more ionizing electrodes.

A typical time for completing the cleaning operation of all of the ionizing electrodes of an ionizer of the present disclosure can be on the order of 1 second or less, and the cleaning operation can be carried out according to any suitable schedule (e.g., once every 24 hours). The cleaning operation can be performed under either automation control or on demand.

In some embodiments, each brush (i.e., bundle of bristles) includes a bundle of relatively stiff bristles. The bristles are typically nonconductive monofilaments (made of, e.g., nylon 66). Other suitable brush materials can be used, including, for example, polypropylene, natural or synthetic rubber, or metal.

In some embodiments, each bundle of bristles can be selected to include the same size, shape (e.g., conical taper, cylindrical), or composition as the other bundles of bristles, while in some other embodiments each bundle of bristles can be selected to include a different size, shape, or composition from other bundles of bristles in the cleaning members. In some embodiments, individual bristles in a bundle of bristles can be selected to include the same size, shape, or composition as the other bristles in the bundles of bristles, while in some other embodiments individual bristles in a bundle of bristles can be selected to include a different size, shape, or composition from other bristles in the bundle of bristles.

Other suitable configurations of ionizers will be evident from a consideration of the possible combinations of at least: cleaning member configuration; ionizing electrode number and positioning; arrangements of rod angular distributions with respect to ionizing electrode positions; predetermined grouping of ionizing electrodes for being either energized or switched off (e.g., for cleaning) as a group (including a group of 1 member) during any given time period; orientation of bristles with respect to electrode longitudinal axis; and cleaning schedule.

EMBODIMENTS

Item 1. An ionizer, comprising:

an ionizing electrode for ionizing air and having a longitudinal first direction; and a cleaning member comprising a plurality of spaced apart bundles of bristles for cleaning the ionizing electrode when the cleaning member comes into contact with the ionizing electrode, each bundle of bristles in the plurality of spaced apart bundles of bristles being offset relative to the other bundles of bristles in the plurality of spaced apart bundles of bristles along the first direction and along a second direction perpendicular to the first direction.

Item 2. The ionizer of item 1, wherein when the cleaning member comes into contact with the ionizing electrode, a first bundle of bristles in the plurality of spaced apart bundles of bristles contacts the ionizing electrode closer to an emission tip of the ionizing electrode and a second bundle of bristles in the plurality of spaced apart bundles of bristles contacts the ionizing electrode farther from the emission tip of the ionizing electrode.

Item 3. The ionizer of item 1, wherein when the cleaning member comes into contact with the ionizing electrode, a first bundle of bristles in the plurality of spaced apart bundles of bristles contacts the ionizing electrode along a first side of the ionizing electrode and a second bundle of bristles in the plurality of spaced apart bundles of bristles contacts the ionizing electrode along an opposite second side of the ionizing electrode.

Item 4. The ionizer of item 1, wherein when the cleaning member comes into contact with the ionizing electrode, at least some of the bristles in the plurality of spaced apart bundles of bristles are oriented along the first direction.

Item 5. The ionizer of item 1, wherein when the cleaning member comes into contact with the ionizing electrode, at least some of the bristles in the plurality of spaced apart bundles of bristles are oriented along a third direction perpendicular to the first and second directions.

Item 6. The ionizer of item 1 comprising a plurality of ionizing electrodes disposed in a same plane, the bristles in the plurality of spaced apart bundles of bristles being oriented generally parallel with the plane.

Item 7. The ionizer of item 1 comprising a plurality of ionizing electrodes disposed in a same plane, the bristles in the plurality of spaced apart bundles of bristles being oriented generally perpendicular to the plane.

Item 8. An ionizer, comprising:

a plurality of ionizing electrodes for ionizing air, each ionizing electrode having an emission tip, the tips of the ionizing electrodes being generally disposed in a first plane; and a plurality of cleaning members, each cleaning member comprising a plurality of spaced apart bundles of bristles for cleaning an ionizing electrode in the plurality of ionizing electrodes when the cleaning member contacts the ionizing electrode, each bundle of bristles in the plurality of spaced apart bundles of bristles being offset relative to the other bundles of bristles in the plurality of spaced apart bundles of bristles along two mutually orthogonal directions parallel to the first plane.

Item 9. The ionizer of item 8, wherein each ionizing electrode in the plurality of ionizing electrodes is elongated along a longitudinal first direction parallel to the first plane, the two mutually orthogonal directions being the first direction and a second direction perpendicular to the first direction.

Item 10. The ionizer of item 9, wherein at least some of the bristles in the plurality of spaced apart bundles of bristles are perpendicular to the first plane.

Item 11. The ionizer of item 8, wherein each ionizing electrode in the plurality of ionizing electrodes is elongated along a longitudinal first direction perpendicular to the first plane, at least some of the bristles in the plurality of spaced apart bundles of bristles being generally parallel to the first plane.

Item 12. An ionizer, comprising:

an ionizing electrode for ionizing air; and a cleaning system for cleaning the ionizing electrode and comprising:

an arm elongated along a longitudinal axis of the arm and comprising a cleaning member, the cleaning member comprising a plurality of spaced apart bundles of bristles for cleaning the ionizing electrode when the cleaning member comes into contact with the ionizing electrode, each bundle of bristles in the plurality of spaced apart bundles of bristles being offset relative to the other bundles of bristles in the plurality of spaced apart bundles of bristles along a first direction parallel to the longitudinal axis of the arm and along a second direction perpendicular to the first direction.

Item 13. The ionizer of item 12, wherein the arm is attached to a center and is configured to rotate about the center to move the cleaning member into contact with the ionizing electrode so that the plurality of spaced apart bundles of bristles clean the ionizing electrode and for moving the cleaning member away from the ionizing electrode.

Item 14. An ionizer comprising a plurality of ionizing electrodes, each ionizing electrode being configured to ionize air, the ionizer being configured so that at least one predetermined ionizing electrode in the plurality of ionizing electrodes does not ionize air when at least one other predetermined ionizing electrode in the plurality of ionizing electrodes ionizes air.

Item 15. The ionizer of item 14, wherein the at least one predetermined ionizing electrode in the plurality of ionizing electrodes that does not ionize air is being cleaned.

Item 16. The ionizer of item 14, the plurality of ionizing electrodes comprising pairs of associated ionizing electrodes with an ionizing electrode in each pair being configured to emit negative ions and the other ionizing electrode in the pair being configured to emit positive ions, the ionizer being configured so that at least one predetermined pair of associated ionizing electrodes in the plurality of ionizing electrodes does not ionize air when at least one other predetermined pair of associated ionizing electrodes in the plurality of ionizing electrodes ionizes air.

Item 17. The ionizer of item 14 being configured so that for a predetermined first time interval each of a first plurality of predetermined ionizing electrodes in the plurality of ionizing electrodes ionizes air and for a subsequent predetermined second time interval each of the first plurality of predetermined ionizing electrodes in the plurality of ionizing electrodes does not ionize air.

Item 18. An ionizer comprising a plurality of ionizing electrodes for ionizing air and being configured so that when an ionizing electrode in the plurality of ionizing electrodes is being cleaned, a different ionizing electrode in the plurality of ionizing electrodes ionizes air.

Item 19. The ionizer of item 18, wherein the ionizing electrode in the plurality of ionizing electrodes that is being cleaned does not ionize air.

Item 20. The ionizer of item 19, the plurality of ionizing electrodes comprising pairs of associated ionizing electrodes with an ionizing electrode in each pair being configured to emit negative ions and the other ionizing electrode in the pair being configured to emit positive ions, the ionizer being configured so that when the ionizing electrodes in a first pair of associated ionizing electrodes in the plurality of ionizing electrodes are being cleaned, the ionizing electrodes in a second pair of associated ionizing electrodes in the plurality of ionizing electrodes emit ions.

Item 21. The ionizer of item 20, wherein the ionizing electrodes in the first pair of associated ionizing electrodes in the plurality of ionizing electrodes that are being cleaned do not ionize air.

Item 22. An ionizer, comprising:

a plurality of ionizing electrodes for ionizing air; and a cleaning member for cleaning the plurality of ionizing electrodes, wherein when the cleaning member cleans a first ionizing electrode in the plurality of ionizing electrodes that is not ionizing air, a different second ionizing electrode in the plurality of ionizing electrodes ionizes air.

Item 23. The ionizer of item 22, wherein when one or more ionizing electrodes in the plurality of ionizing electrodes that do not ionize air are being cleaned, the remaining ionizing electrodes in the plurality of ionizing electrodes ionize air.

Item 24. An ionizer, comprising:

first and second ionizing electrodes for emitting ions, a predetermined one of the first and second ionizing electrodes emitting ions, a predetermined other one of the first and second ionizing electrodes not emitting ions; and a cleaning member contacting and cleaning the predetermined ionizing electrode that is not emitting ions.

Item 25. An ionizer, comprising:

a plurality of ionizing electrodes for ionizing air;

a plurality of cleaning members for contacting and cleaning the plurality of ionizing electrodes, the cleaning members in the plurality of cleaning members being so arranged relative to the ionizing electrodes in the plurality of ionizing electrodes so that when a cleaning member in the plurality of cleaning members contacts an ionizing electrode in the plurality of ionizing electrodes, at least one other cleaning member in the plurality of cleaning members does not contact any ionizing electrode in the plurality of ionizing electrodes.

Item 26. The ionizer of item 25, the cleaning members in the plurality of cleaning members being so arranged relative to the ionizing electrodes in the plurality of ionizing electrodes so that when each of a first pair of cleaning members in the plurality of cleaning members contacts each of a first pair of ionizing electrodes in the plurality of ionizing electrodes, each of another pair of cleaning member in the plurality of cleaning members does not contact any ionizing electrode in the plurality of ionizing electrodes.

Item 27. The ionizer of item 26, wherein one of the ionizing electrodes in the first pair of ionizing electrodes is configured to emit positive ions and the other ionizing electrode in the first pair of ionizing electrodes is configured to emit negative ions.

Item 28. The ionizer of item 25 comprising equal number of ionizing electrodes and cleaning members.

Item 29. An ionizer, comprising:

a plurality of ionizing electrodes for ionizing air; and a plurality of cleaning members for contacting and cleaning the plurality of ionizing electrodes, each cleaning member being configured to clean one ionizing electrode at a time and comprising a plurality of spaced apart bundles of bristles, each bundle of bristles in the plurality of spaced apart bundles of bristles being offset relative to the other bundles of bristles in the plurality of spaced apart bundles of bristles along at least two mutually orthogonal directions, such that when one cleaning member cleans an ionizing electrode, another cleaning member does not clean any other ionizing electrode.

Item 30. The ionizer of item 29, the plurality of ionizing electrodes comprising pairs of associated ionizing electrodes with an ionizing electrode in each pair being configured to emit negative ions and the other ionizing electrode in the pair being configured to emit positive ions, the ionizer being configured so that when the ionizing electrodes in a first pair of associated ionizing electrodes in the plurality of ionizing electrodes are being cleaned, the ionizing electrodes in a second pair of associated ionizing electrodes in the plurality of ionizing electrodes emit ions.

What is claimed is:

1. An ionizer, comprising:

a plurality of ionizing electrodes for ionizing air, wherein each ionizing electrode of the plurality of ionizing electrodes has a longitudinal first direction;

a plurality of cleaning members for contacting and cleaning the plurality of ionizing electrodes, the cleaning members in the plurality of cleaning members being so arranged relative to the ionizing electrodes in the plurality of ionizing electrodes so that when a cleaning member in the plurality of cleaning members contacts an ionizing electrode in the plurality of ionizing electrodes, at least one other cleaning member in the plurality of cleaning members does not contact any ionizing electrode in the plurality of ionizing electrodes, wherein each cleaning member of the plurality of cleaning members comprises a plurality of spaced apart bundles of bristles for cleaning at least one ionizing electrode of the plurality of ionizing electrodes when the cleaning member comes into contact with the at least one ionizing electrode, and wherein a first bundle of bristles in the plurality of spaced apart bundles of bristles is disposed to be offset relative to a second bundle of bristles in the plurality of spaced apart bundles of bristles along the longitudinal first direction and along a second direction perpendicular to the longitudinal first direction.

2. The ionizer of claim 1, wherein the cleaning members in the plurality of cleaning members are so arranged relative to the ionizing electrodes in the plurality of ionizing electrodes, that when each of a first pair of cleaning members in the plurality of cleaning members contacts each of a first pair of ionizing electrodes in the plurality of ionizing electrodes, each of another pair of cleaning members in the plurality of cleaning members does not contact any ionizing electrode in the plurality of ionizing electrodes.

3. The ionizer of claim 1, wherein when the cleaning member in the plurality of cleaning members comes into contact with the ionizing electrode in the plurality of ionizing electrodes, the first bundle of bristles in the plurality of spaced apart bundles of bristles contacts the ionizing electrode closer to an emission tip of the ionizing electrode and the second bundle of bristles in the plurality of spaced apart bundles of bristles contacts the ionizing electrode farther from the emission tip of the ionizing electrode.

4. The ionizer of claim 1, wherein when the cleaning member in the plurality of cleaning members comes into contact with the ionizing electrode in the plurality of ionizing electrodes, at least some of the bristles in the plurality of spaced apart bundles of bristles are oriented along a third direction perpendicular to the first and second directions.

5. The ionizer of claim 1, wherein the ionizer is configured so that during the time that the cleaning member in the plurality of cleaning members contacts the ionizing electrode, the ionizing electrode does not ionize air while at least one other ionizing electrode of the plurality of ionizing electrodes does ionize air.

6. An ionizer, comprising:

a plurality of ionizing electrodes for ionizing air;

a plurality of cleaning members for contacting and cleaning the plurality of ionizing electrodes, the cleaning members in the plurality of cleaning members being so arranged relative to the ionizing electrodes in the plurality of ionizing electrodes so that when a first cleaning member in the plurality of cleaning members contacts a first ionizing electrode in the plurality of ionizing electrodes, at least one other cleaning member in the plurality of cleaning members does not contact any ionizing electrode in the plurality of ionizing electrodes, wherein the ionizer is configured so that during the time that the first cleaning member contacts the first ionizing electrode, the first ionizing electrode does not ionize air while at least one other ionizing electrode of the plurality of ionizing electrodes does ionize air.

7. The ionizer of claim 6, wherein the cleaning members in the plurality of cleaning members are so arranged relative to the ionizing electrodes in the plurality of ionizing electrodes, that when each of a first pair of cleaning members in the plurality of cleaning members contacts each of a first pair of ionizing electrodes in the plurality of ionizing electrodes, each of a second pair of cleaning members in the plurality of cleaning members does not contact any ionizing electrode in the plurality of ionizing electrodes, and wherein the ionizer is configured so that during the time that each of the first pair of cleaning members in the plurality of cleaning members contacts each of the first pair of ionizing electrodes in the plurality of ionizing electrodes, each of the first pair of ionizing electrodes does not ionize air while at least one other pair of ionizing electrodes of the plurality of electrodes does ionize air.

8. The ionizer of claim 7, wherein the ionizer is further configured so that one of the ionizing electrodes in the first pair of ionizing electrodes emits positive ions and the other of the ionizing electrodes in the first pair of ionizing electrodes emits negative ions when none of the plurality of cleaning members contacts any of the first pair of ionizing electrodes, and wherein the ionizer is further configured so that one of the ionizing electrodes in the at least one other pair of ionizing electrodes emits positive ions and the other of the ionizing electrodes in the at least one other pair of ionizing electrodes emits negative ions when none of the plurality of cleaning members contacts any of the at least one other pair of ionizing electrodes.

* * * * *